US006112444A

United States Patent [19]

Milliken et al.

[11] Patent Number: 6,112,444

[45] Date of Patent: Sep. 5, 2000

[54] FRAMING MEMBER FOR USE IN ASSEMBLING A BLEED SIGN FACE CONSTRUCTION

[76] Inventors: Les Milliken, 305 Gladstone Blvd.; K. Blair Milliken, 175 Tyler Ave., both of Englewood, Fla. 34223; Steven LaFountain, 1229 Whitney Dr., Venice, Fla. 34292

[21] Appl. No.: 08/865,197

[22] Filed: May 29, 1997

Related U.S. Application Data

[60] Provisional application No. 60/020,895, Jun. 27, 1996.

[51] Int. Cl.[7] ..... G09F 17/00

[52] U.S. Cl. ..... 40/603; 40/564; 40/572; 52/720.1; 428/586

[58] Field of Search ..... 40/549, 564, 572, 40/575, 603; 52/222, 720.1, 732.1; 428/586, 598

[56] References Cited

U.S. PATENT DOCUMENTS

| | | | |
|---|---|---|---|
| 4,817,317 | 4/1989 | Kovalak, Jr. | 40/603 |
| 4,926,605 | 5/1990 | Milliken et al. | 52/63 |
| 5,020,254 | 6/1991 | Sheppard | 40/603 |
| 5,207,262 | 5/1993 | Rushford | 160/354 |
| 5,647,176 | 7/1997 | Milliken et al. | 52/222 X |

OTHER PUBLICATIONS

SignComp Extrusions for the Sign Industry Price List, pp. 8–9 and 14, Fall 1986.

Klick–Rail, The Latest in Face Tensioning Systems Advertisement, Signs of the Times, p. 166, Jul., 1988.

*Primary Examiner*—Terry Lee Melius
*Assistant Examiner*—Andrea Chop
*Attorney, Agent, or Firm*—Dann Dorfman Herrell and Skillman; Donald R. Piper, Jr.

[57] ABSTRACT

A framing member for use in a bleed sign construction assembly, the construction assembly including a projecting mounting surface and at least one construction light fixture arrayed proximate to the projecting mounting surface which is encased within a light permeable covering material. A substantially elongate and joinable member includes a body with a selected width and height in cross section and a longitudinally extending channel which reveals an interior cavity of the body. A first flange extends longitudinally from along a first side of the body and secures to the mounting surface to arrange the body at a spaced distance therefrom. A second flange extends longitudinally from along a second and opposite side of the body terminates along a remote extending edge. A plurality of the framing members are connected in end to end fashion to form a closed perimeter and the covering material is anchored within the interconnected channels and drawn across the framing members.

25 Claims, 13 Drawing Sheets

FRAMING MEMBER FOR USE IN ASSEMBLING A BLEED SIGN FACE CONSTRUCTION

This application claims priority of provisional application Ser. No. 60/020,895 filed Jun. 27, 1996.

BACKGROUND OF THE INVENTION

1. Field of the Invention

The present invention relates generally to extrusion members used in the construction of sign and display assemblies and, more particularly, to a framing member for use in assembling a bleed sign face construction.

2. Description of the Prior Art

Construction assemblies are well known in the art for creating an enclosure structure such as is typically used in awnings, canopies, boat coverings, signs and displays. Traditionally, such frame constructions have included a frame composed of tubular aluminum members which are secured together in some fashion, such as by welding. A material is then stretched over and tied to the frame.

U.S. Pat. No. 4,926,605, issued to Milliken et al., discloses a construction assembly for awning and canopy closures which includes a frame constructed of a plurality of elongated, joinable members. Each of the members includes a body with first and second channel walls and a channel base which defines a longitudinal channel. A flexible covering material is provided which, upon construction of the members into an awning or like frame structure, is anchored within the interconnected and elongate channels to form a covered assembly.

Attempts have also been made in the prior art to construct sign boxes with standard tubular members which feature substantially edge-to-edge illumination. The most common method employed in sign box construction requires the provision of a plurality of separately fabricated tubular members which are assembled together using fasteners in an enclosure of some sort and which further require clips to secure a fabric to the constructed frame. A primary shortcoming of such conventional systems is the cost. The high cost is due to the material and labor necessary to build the bleed face sign. The prior art includes slots having serrations therein which, in combination with a clip, hold the fabric in place.

SUMMARY OF THE PRESENT INVENTION

The present invention is a framing member for use in new and retrofit bleed sign construction assemblies, particularly gas island facia extrusions and sign boxes. The construction assembly includes a projecting mounting surface, typically a portion of a signbox, and a plurality of light fixtures arrayed proximate to the projecting mounting surface. A substantially elongate and joinable member includes a body which is defined in cross section by a selected width and height and includes a longitudinally extending channel which reveals an interior cavity of the body.

A first flange extends longitudinally from along a first side of the body and secures to the projecting mounting surface of the construction assembly so as to arrange the body at a spaced distance therefrom. A second flange extends longitudinally from along a second opposite side of the body and terminates in a bulbous shaped remote extending edge. A plurality of the framing members according to this configuration are connected together in an angled and end to end fashion to form a surrounding perimeter which is according to predetermined dimensions.

A flexible and light permeable covering member is provided and is preferably a translucent or opaque polyester or vinyl material. The covering member is anchored within the longitudinally extending channel of each of the longitudinally extending frame bodies by staples. A plurality of vinyl inserts are inserted within the extending channels and operate to pinch the covering member in the channels so that the covering members are drawn taut over the bulbous shaped and remote extending edges in order to give the covering member an overall attractive appearance. Upon assembly, the light fixtures illuminate through the installed covering material which includes some form of identifying indicia in order to provide an attractive display.

BRIEF DESCRIPTION OF THE DRAWINGS

Reference is now made to the attached drawings, when read in combination with the following specification, wherein like reference numerals refer to like parts throughout the several views, and in which.

DESCRIPTION OF THE PREFERRED EMBODIMENTS

Figure 1:
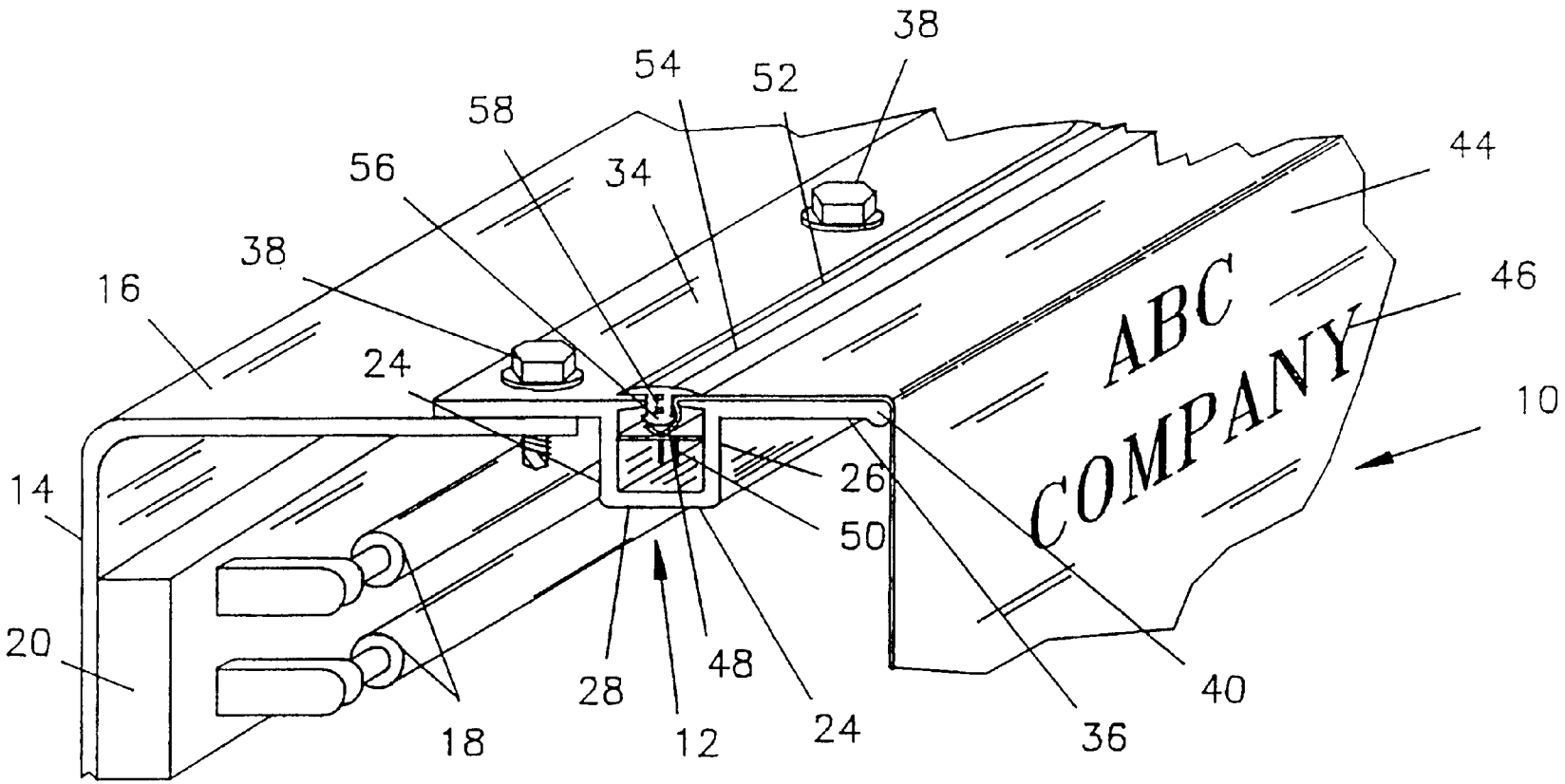
FIG. 1 is a view in perspective and cutaway of a framing member used in a bleed sign construction assembly according to a first preferred embodiment of the present invention.
Figure 3:
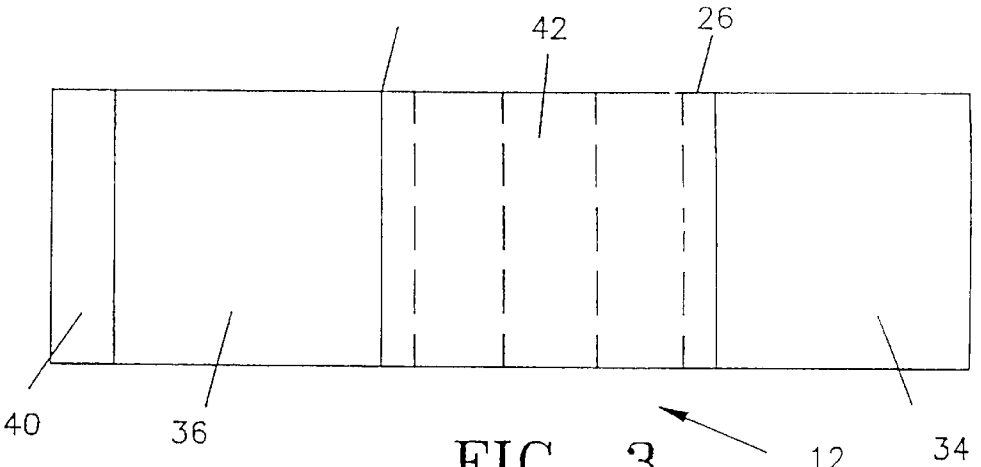
FIG. 3 is a top view in reduced length and illustrated partially in phantom of the framing member according to the first preferred embodiment of the present invention.
Figure 2:
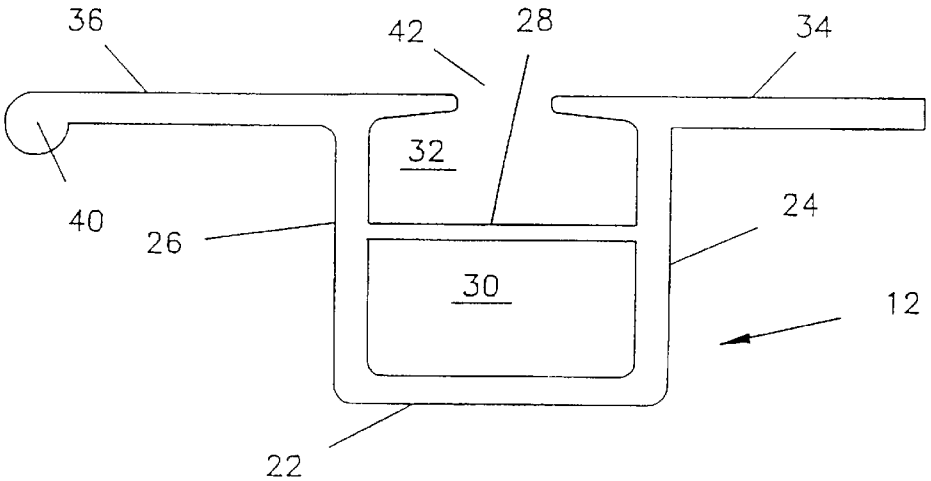
FIG. 2 is an end view illustrating the cross section of the framing member according to the first preferred embodiment of the present invention.
Figure 4:
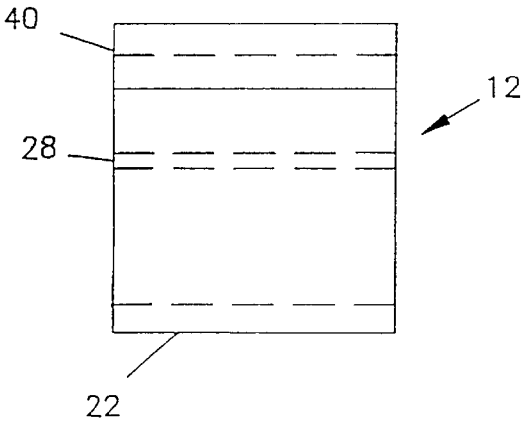
FIG. 4 is a front side view in reduced length and illustrated partially in phantom of the framing member according to the first preferred embodiment of the present invention.

Referring now to FIG. 1, a bleed sign construction assembly 10 is shown according to a first preferred embodiment of the present invention for creating or retrofitting a sign face such as is employed in a gas station island and which employs a first configured framing member 12. The construction assembly 10 includes a projecting mounting surface which consists of a substantially "L" shaped member having a first mounting surface 14 and a second projecting surface 16. A plurality of longitudinally extending light fixtures, illustrated in FIG. 1 by fluorescent lighting rods 18, are mounted to a base 20 which is in turn secured to the first projecting surface 14 and which extends in a substantially horizontal and parallel fashion beneath the second projecting surface 16.

Referring again to FIG. 1, and also to FIGS. 2–5, the framing member 12 is constructed of an elongated and joinable member. The framing member 12 is constructed of a lightweight metal having high strength and durability and is preferably of an aluminum composition, such as 6063 T5 aluminum alloy. As is best shown in the cross sectional illustrations of FIGS. 1, 2 and 5, the framing member 12 includes a body having a base 22, a first upwardly extending side 24 and a second upwardly extending side 26 which establishes a generally "U" shape. A cross member 28 extends from a midpoint of the first side 24 to a corresponding position of the second side 26 and divides an open interior of the body so as to create a lower longitudinally extending closed cavity 30 and an upper longitudinally extending cavity 32.

Figure 5:
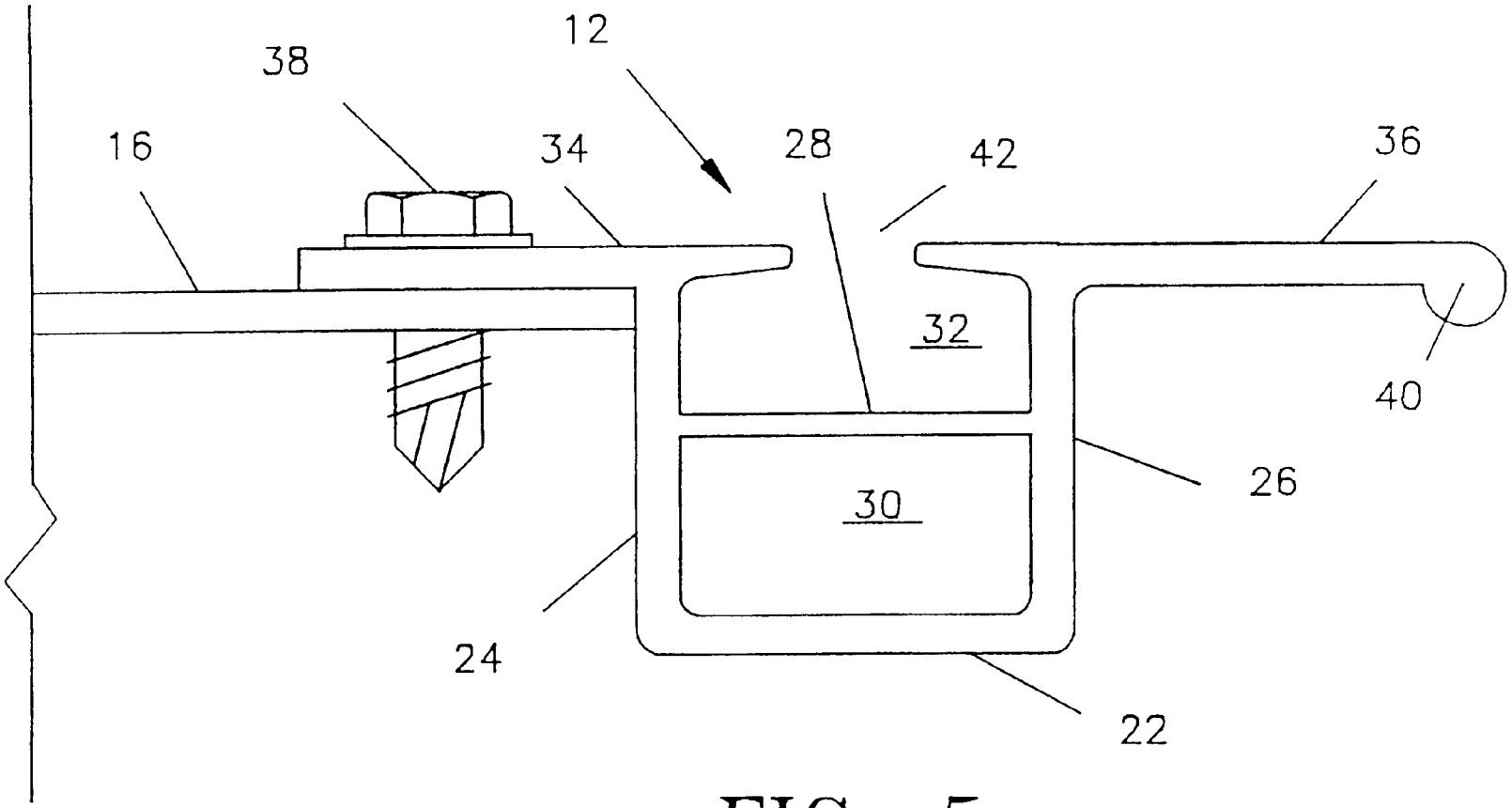
FIG. 5 is an enlarged view in section of the framing member as shown in FIG. 1 secured to a projecting mounting surface according to the first preferred embodiment of the present invention.

A first flange 34 extends longitudinally from along the first extending side 24 of the body and a second flange 36 likewise extends longitudinally from along the second extending side 26 of the body. Both the flanges 34 and 36 preferably extend in a substantially perpendicular fashion from an upper edge of each of the corresponding sides 24 and 26 of the body and are formed as substantially planar members with desired widths and thicknesses. As is best shown in FIGS. 1 and 5, the first flange 34 is positioned to overlap an upper surface of the second projecting mounting surface 16 so that a remote extending edge of the projecting mounting surface 16 is in abutting contact with the first side 24 of the framing member body.

A mounting bolt or like fastener 38 includes a head portion and an extending and threaded shaft portion and the shaft portion is frictionally engaged through overlapping apertures (not illustrated) in the first flange 34 and the second projecting mounting surface 16 to fixedly engage the body of the framing member 12 at a spaced distance from the projecting mounting surface 16. This process is known as TEK screwing. Alternatively, flange 34 could be hinged to mounting surface 16 for easy access to service the equipment inside. As is best illustrated in the perspective view of FIG. 1, a plurality of fasteners 38 are shown at spaced apart intervals for securing the framing member 12 to the mounting surface 16.

The second flange 36 extends in an opposite direction from the second side 26 of the framing member body and terminates in a remote extending edge which is defined by a substantially circular, bulbous shaped end 40. Both the first flange 34 and second flange 36 also extend inwardly beyond the first side 24 and second side 26 of the "U" shaped body and terminate short of one another to create a desired gap or longitudinally extending channel 42 which permits access into the upper longitudinally extending cavity 32. See, FIG. 2.

Referring again to FIG. 1, a covering material 44 is provided which is installed over the framing member 12 in a fashion as will now be described. The covering material 44 is constructed of a vinyl or polyester impregnated fabric which is either translucent or opaque in nature so as to permit light from an interiorly positioned light source (the fluorescent lighting rods 18) to bleed completely through the material 44 and to illuminate a design or advertising indicia 46 of some type so that it may be easily discerned by an observer situated at some distance in either daylight or darkness.

As is shown in FIG. 1, a trailing edge portion 48 of the covering material 44 is fitted into the longitudinally extending channel 42 and is secured to the cross member 28 within the "U" shaped channel body by staples 50 which are applied at predetermined spaced intervals and which pierce the cross member 28 to secure the edge 48 of the covering material 44. A plurality of elongate and flexible insert portions 52, preferably constructed of a vinyl or like material, are provided for fitting through the longitudinally extending channel 42 and into the upper longitudinally extending cavity 32 upon stapling of the edge of the covering material to the cross member 28 and within the upper cavity 32. Alternatively, flat stock may be used instead of the vinyl insert. The insert portions 52 each include an upper portion 54 with a pair of substantially planar and downwardly facing lips and a lower and outwardly flared portion 56 with upwardly facing lips which is separated from the upper portion 54 by a connecting web 58. The inserts are press fit longitudinally either manually or, with the use of a tool so that the oppositely facing lips separated by the web adhere to the inner and outer surfaces of the flanges 34 and 36. Upon being attached, the covering material 44 extends across an upwardly facing surface of the second longitudinally extending and planar faced flange 36 and drapes over the bulbous shaped and remote edge 40 of the flange 36 in the fashion illustrated in FIG. 1.

Figure 6:
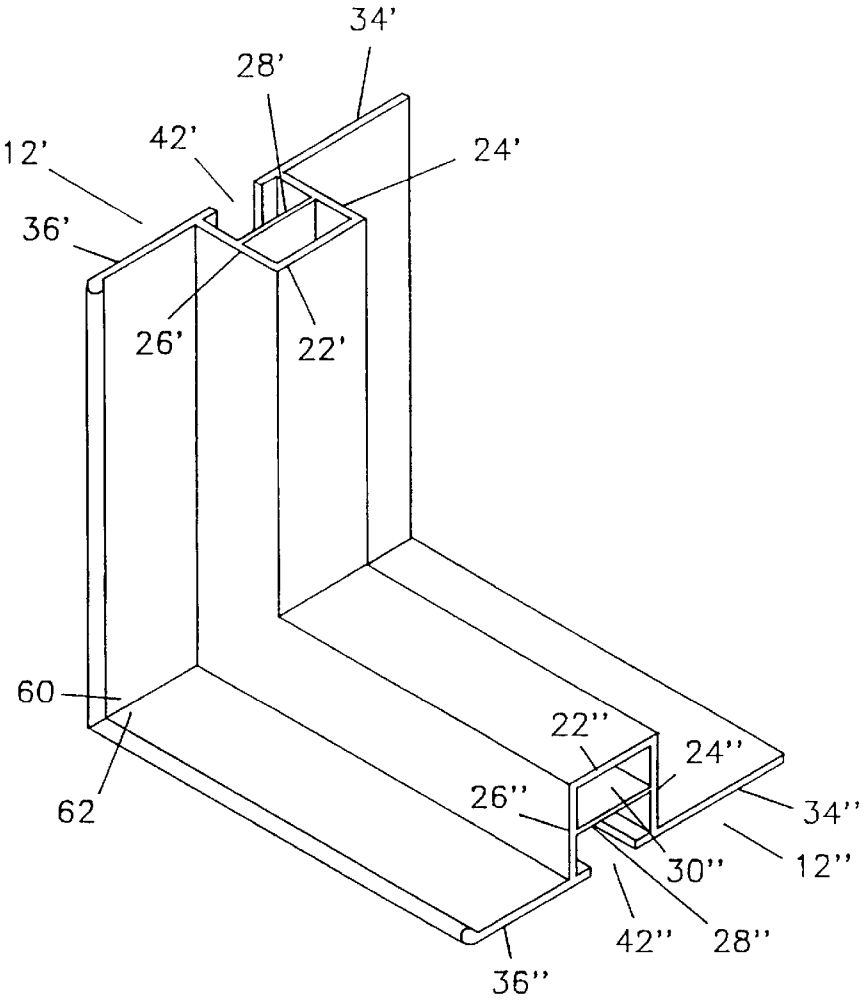
FIG. 6 is a view in section of a pair of framing members which are connected together in an angular fashion for establishing an enclosed perimeter of the assembly according to the first preferred embodiment of the present invention.

The view of FIG. 1 illustrates a cutaway of a bleed sign construction according to the first preferred embodiment with only an upper and first horizontally extending framing member 12 being shown and it is envisioned that a number of framing members 12 are arranged in an angular and end-to-end fashion in order to form a closed perimeter around the projecting mounting surface. Referring to FIG. 6, a view in cutaway is illustrated of a pair of framing members 12' and 12" which are connected together in an angular fashion. Most sign enclosures created according to the construction assembly of the present invention present some form of polygonal shape in cross section, a polygon being defined by as few as three sides and as many as an infinite number of sides which equals a circle. It is however envisioned that the majority of such sign box enclosures will include first, second, third and fourth sides in order to create a generally rectangular shaped enclosure which is the most commonly used shape in the art.

As is illustrated in FIG. 6, the framing member 12' is miter cut at a connecting end 60 and the member 12" is likewise cut at a connecting end 62. Cutting of the framing members is typically accomplished by conventional tools such as a radial arm saw or chop saw. The framing members 12' and 12" are otherwise configured identically to the framing member 12 previously described and include such features as bases 22' and 22", first upwardly extending sides 24' and 24", second upwardly extending sides 26' and 26" and cross members 28' and 28". The cross members 28' and 28" create lower longitudinally extending and closed cavities 30' and 30" and upper longitudinally extending cavities 32' and 32" which are accessible by longitudinally extending channels 42' and 42", the channels separating the first flanges 34' and 34" from the second flanges 36' and 36".

In one preferred embodiment, the framing members 12' and 12" are secured together by welding or by other conventional fabrication means for creating an enclosing frame structure. It is also envisioned that a similar corner support member may be secured within the associated longitudinally extending cavities by adhesives.

Envisioning FIGS. 1 and 6 in combination, it is easily understood how a plurality of angularly disposed framing members are assembled together and attached to a projecting mounting surface so as to define a desired shaped enclosure which surrounds a plurality of lighting elements. The light permeable covering material 44 is then provided according to predetermined dimensions so that the edges are fitted within the longitudinally extending channels defining the surrounding enclosure and are then stapled in place. The elongated inserts are then flexibly inserted within the channels to pinch the edges of the covering material and to stiffen the material so as to present an overall drum tight and taut appearance. The surrounding bulbous shaped ends of the second flanges provide a smooth and curved edge around the entire perimeter of the enclosure and prevent damage and tearing of the covering material which might otherwise occur with a sharp edge. In use, the framing member and construction assembly according to the first preferred embodiment provides an attractive facia extrusion, for instance, for gas island canopies, light barns and other wall or pole signs, which enables the light from the internally mounted lighting fixtures to completely bleed through the fabric covering material to provide top to bottom and side to side full illumination to the outer perimeter dimension of the sign box.

Figure 7:
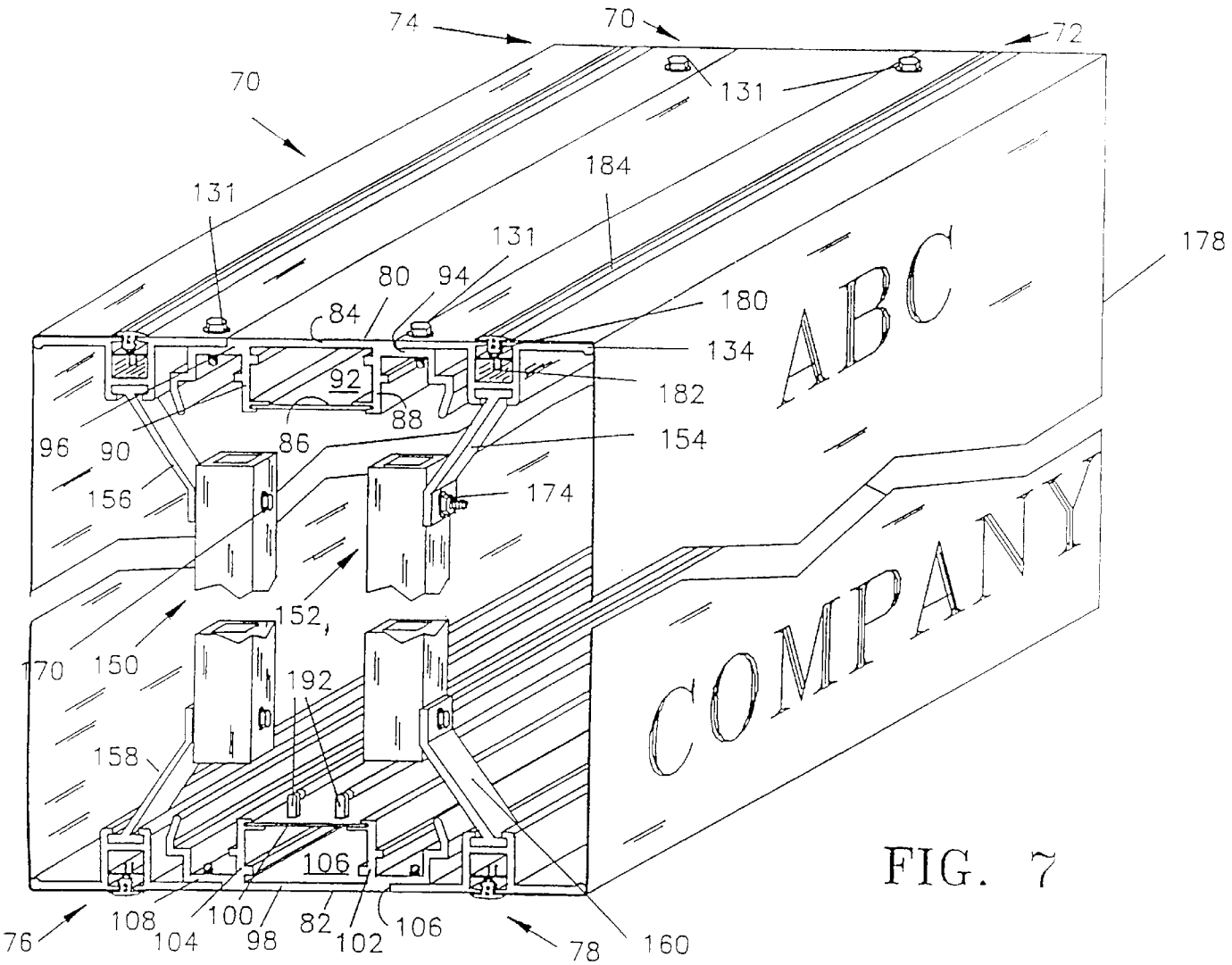
FIG. 7 is a view in perspective and cutaway of a plurality of framing members for use in a bleed sign construction assembly according to a second preferred embodiment of the present invention.

Referring now to FIG. 7, a bleed sign construction assembly 70 is shown which incorporates a plurality of individual framing members 72, 74, 76 and 78 according to a further preferred embodiment of the present invention. The sign construction assembly 70 according to the further preferred embodiment is particularly useful for either creating new or retrofitting existing sign box assemblies.

Each construction assembly 70 typically includes a substantially horizontally arranged and longitudinally extending upper sign box member 80 and a likewise parallel extending and spaced apart lower sign box member 82. The sign boxes 80 and 82 are each substantially rectangular in shape with an open interior cavity and further include laterally projecting ends. Specifically, the upper sign box 80 includes a first planar surface 84 and a second planar surface 86 which are spaced apart by a first side 88 and a second side 90 so as to form an interior cavity 92 and further includes a first laterally projecting end 94 and a second opposite laterally projecting end 96. Likewise, the lower sign box 82 includes a first planar surface 98 and a second planar surface 100 which are spaced apart by a first side 102 and a second side 104 so as to form an interior cavity 106 and further includes a first laterally projecting end 106 and a second opposite laterally projecting end 108.

Figure 8:
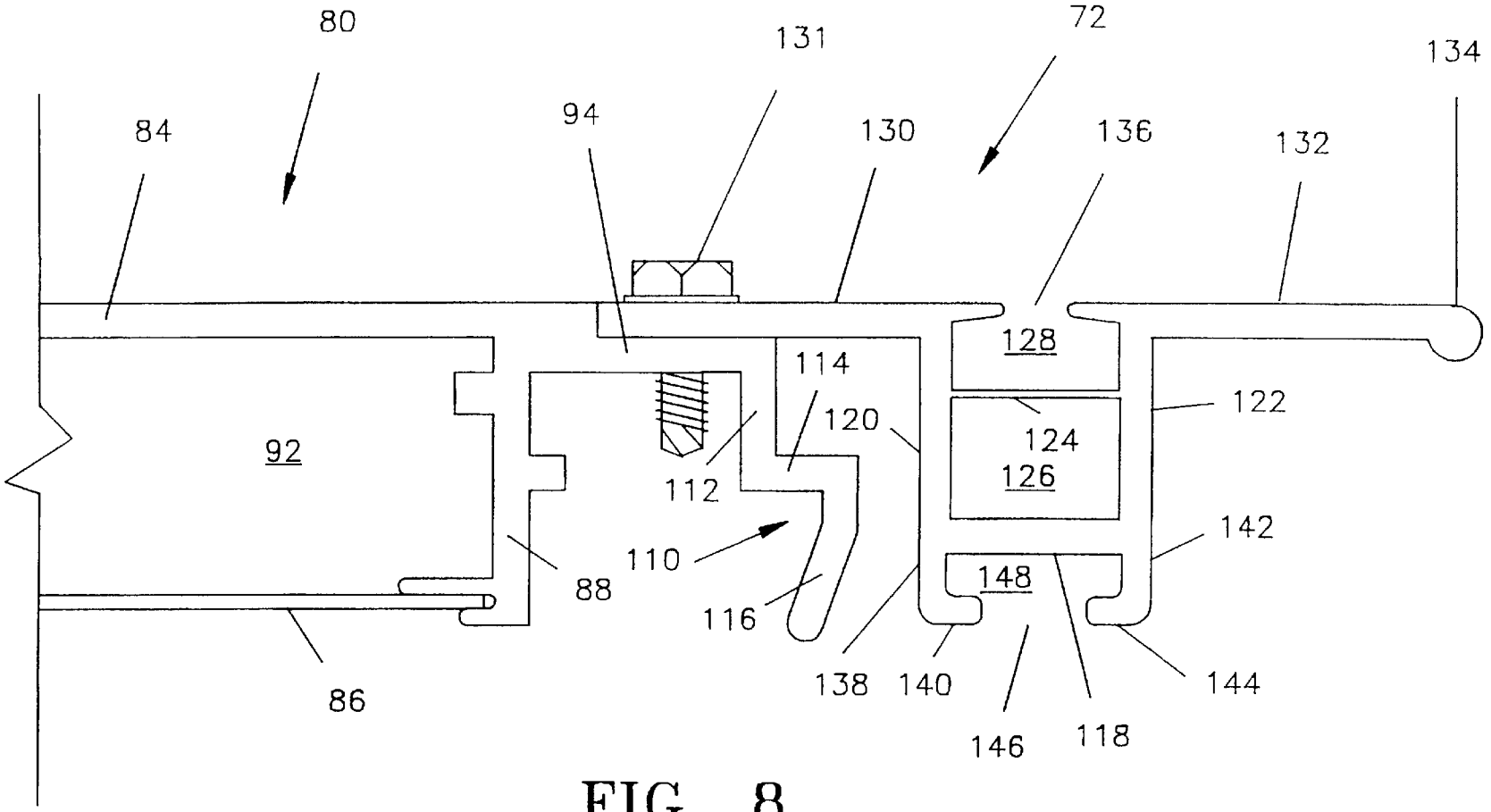
FIG. 8 is an enlarged view in section of the framing member as shown in FIG. 7 secured to a projecting mounting surface according to the second preferred embodiment of the present invention.

Each of the laterally projecting ends 94, 96, 106 and 108 further include an angularly extending and stepped side member, such as is illustrated by side member 110 of lateral end 94 in the sectional view of FIG. 8. The purpose of the stepped side members is, in extreme cases, to provide an abutting contact surface in response to excessive deflection of an associated framing member (illustrated in FIG. 8 by framing member 72) to maintain the integrity of the construction assembly during adverse weather conditions. As is best illustrated in FIG. 8, the laterally projecting end 94 of the sign box 80 terminates in the angularly extending side member 110, the side member 110 being defined in succession by a first downwardly extending leg 112, a second outwardly extending leg 114 and a third downwardly and manually tapered terminating portion 116 which is arranged at a desired spaced distance from the associated framing member (framing member 72).

Figure 11:
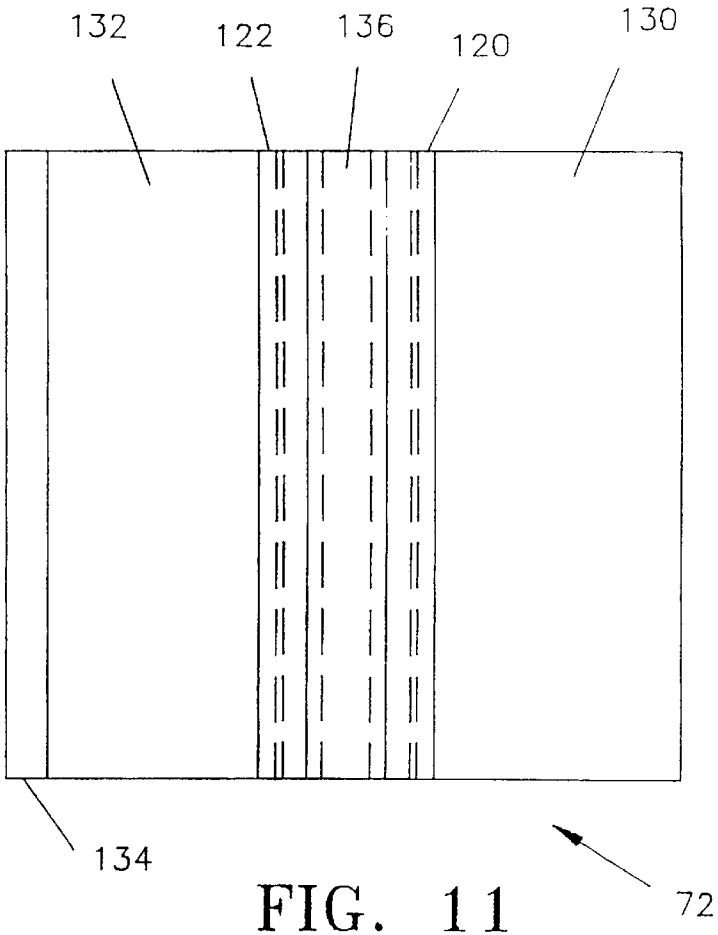
FIG. 11 is a top view in reduced length and illustrated partially in phantom of the framing member according to the second preferred embodiment of the present invention.
Figure 12:
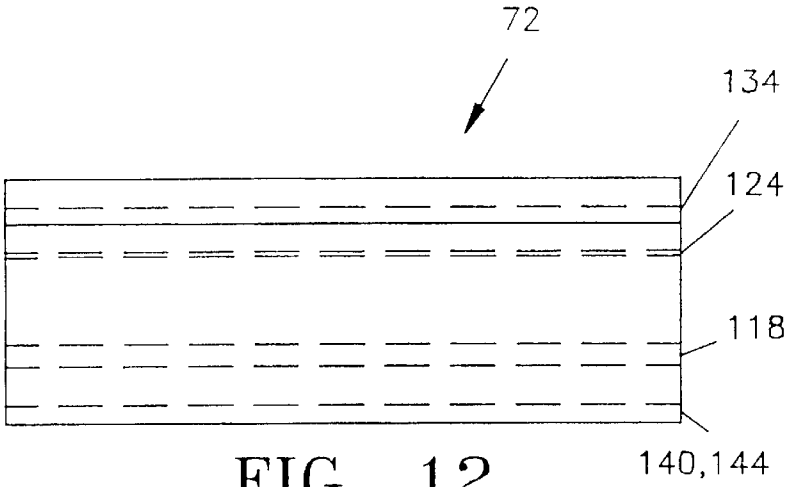
FIG. 12 is a front side view in reduced length and illustrated partially in phantom of the framing member according to the second preferred embodiment of the present invention.
Figure 10:
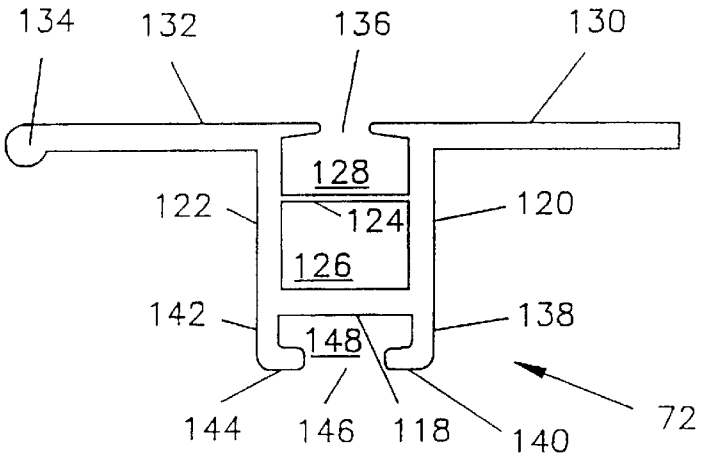
FIG. 10 is an end view illustrating the cross section of the framing member according to the second preferred embodiment of the present invention.

Referring again to FIG. 8, as well as to FIGS. 10, 11 and 12, the elongate and joinable framing member 72 according to the second preferred embodiment is illustrated in cross section and includes a body which is defined by a base 118, a first upwardly extending side 120 and a second upwardly extending and spaced apart side 122. A cross member 124 extends from a generally midpoint of the first upwardly extending side 120 to a like point along the second upwardly extending side 122 and divides the substantially hollowed interior of the body into a central longitudinally extending and enclosed cavity 126 and a first outer longitudinally extending cavity 128.

A first flange 130 and a second flange 132 are provided and extend in opposite directions from corresponding upper edges of the first and second upwardly extending sides 120 and 122, respectively. The flanges 130 and 132 are each substantially planar shaped in cross section with established widths and flattened upper and lower surfaces and likewise extend longitudinally along the framing member 72. The lower planar face and outer edge of the first flange 130 is positioned so that the flange 130 seats upon a downwardly stepped portion of the laterally projecting end 94 and a fastener, such as bolt 131, inserts through overlapping apertures formed in the first flange 130 and projecting end 94 (not shown) in a tight friction engaging manner to secure the frame member 72 to the sign box 80 and to space the body of the member at a spaced distance. As is shown in FIG. 7, a plurality of fasteners 131 are illustrated in spaced apart manner for securing the framing members in place. Sign box 80 is a typically existing sign box which is retrofitted as illustrated in FIGS. 7 and 8.

The second flange 132 is configured substantially identically to the first flange 130, except that it extends to a remote edge which is shaped as a bulbous end portion 134 for facilitating application of the covering material, as will be subsequently described. Both the first flange 130 and second flange 132 further extend inwardly beyond the first and second upwardly extending sides 120 and 122 of the body and terminate at a specified distance from one another in order to form a first longitudinally extending channel 136 which provides access into the first outer longitudinally extending cavity 128. The first side portion 120 and second side portion 122 each further extend beyond the base 118, as illustrated by portions 138 and 142, respectively, and curve inwardly at 140 and 144 towards one another to define a second longitudinally extending channel 146 which permits entry into a second outer longitudinally extending cavity 148, the purpose for which will also be subsequently described. Each of the additional framing members 74, 76 and 78 which are illustrated in FIG. 7 are constructed identically and secured in similar fashion to their corresponding sides of the sign boxes so that repetition of the identical features on those framing members is unnecessary.

Referring again to FIG. 7, the construction assembly 70 further includes a plurality of vertically extending back braces for providing strength and shadowless design to the assembly. The illustration of FIG. 7 illustrates a first back brace 150 and a second parallel and spaced apart back brace 152 which are shown in reduced length for ease in presentation. The back braces 150 and 152 are each substantially rectangular shape in cross section and are internally hollowed to reduce material expenses. It is also understood that there are at least one or more additional pairs of vertical back braces throughout the overall length of the assembly 70 for providing adequate support.

Figure 9:
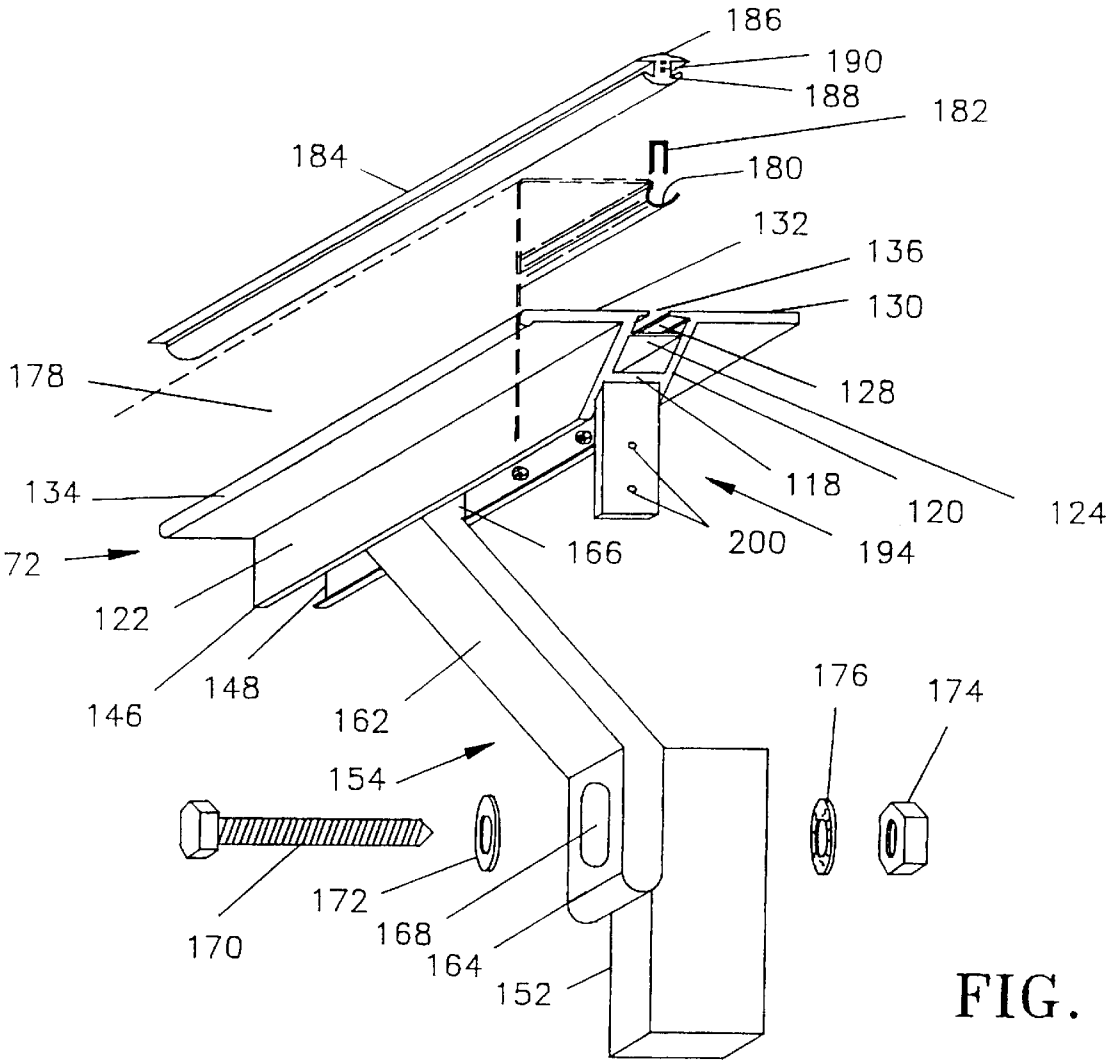
FIG. 9 is an exploded view in section of a sign backset brace and tensioning bar according to the second preferred embodiment of the present invention.

Referring to FIGS. 7 and 9, a plurality of backset braces are illustrated for likewise securing to the framing members and for mounting the framing members at another location to the internally positioned and vertically extending back braces. Specifically, FIG. 7 illustrates a first backset brace 154, a second backset brace 156, a third backset brace 158 and a fourth backset brace 160 for respectively mounting the first framing member 72, second framing member 74, third framing member 76 and fourth training member 78 illustrated in cutaway.

With reference to the exploded view of FIG. 9, only the connection between the first backset brace 154 and the first framing member 72 will be discussed in detail for purposes of ease of illustration and referencing of elements. The backset brace 154 includes a substantially planar body with a specified width and thickness and which is preferably constructed of a similar aluminum alloy as the framing members. The backset brace 154 includes a body with a central extending portion 162, a first angled and back brace engaging portion 164 and a second angled frame member engaging portion 166.

The first angled engaging portion 164 extends at a generally obtuse angle relative to the central extending portion 162 such that it aligns flush with a selected planar surface of the backset brace 152. A slotted portion 168 is formed in the first angled engaging portion 164 and is dimensioned so that a shaft portion of a fastener bolt 170 may be inserted therethrough. The shaft of the bolt 170 also is inserted through a mounting aperture located in an upper end of the backset brace 152, not shown, so that a washer 172 abuts against the head of the fastener on one side of the backset brace 152 and a nut 174 and spring clip washer 176 mount to a remote end of the shaft which extends through an opposing face of the backset brace.

The second angled frame member engaging portion 166 extends at a generally acute angle relative to the central extending portion 162 and is configured so that it is capable of being slidably inserted within a selected cross sectional end of the second outer longitudinally extending cavity 148. The angled engaging portion 166 is carefully dimensioned so that it closely matches the dimensions of the cavity 148 and the connecting end of the central extending portion 162 is capable of likewise translating in an axial direction along the second longitudinally extending channel 146.

When viewing FIGS. 7 and 9 together, it is clearly evident that the second angled engaging portion 166 of the backset brace 154 is positioned fixedly at a selected axial distance within the longitudinally extending cavity 148 of the framing member 72 due to the fact that the framing member is fixedly secured to the sign box along its first extending flange 130. In a preferred embodiment, the angled engaging portion 166 of the backset brace 154 is axially slidably inserted within the cavity 148 of the framing member 72, the first flange 130 of the framing member is bolted to the lateral projecting end 94 of the associated sign box 80 and the backset brace is then axially repositioned so that other angled engaging portion 164 is bolted in place to the planar face of the vertically extending back brace 152. See FIGS. 7 and 8. In this manner, a three dimensional and free standing sign box may be created out of the assembly 70 which is both lightweight and durable in construction. Also, while not illustrated in the drawings, it is understood that some form of upwardly extending pedestal mount is provided for displaying the sign box at an elevated position in which both sides and ends are displayed.

Still referring to FIGS. 7 and 9, a flexible covering material 178 is provided which is identical to that disclosed as 44 in the first preferred embodiment and includes a vinyl or like material with a displaying indicia and which may be further polyester impregnated and light permeable, A trailing edge 180 of the covering material 178 is fitted within the longitudinally extending cavity 128 which is accessible from the longitudinally extending channel 136 and is stapled to the cross member 124 by staples 182. A flexible insert 184, such as an elastic and cushioned vinyl or like material, includes an upper portion 186 with flattened downwardly facing lips, a lower outwardly flared portion 188 with flattened and upwardly facing lips and an interconnecting web portion 190.

Upon stapling of the trailing edge of the covering material, the flexible inserts are then inserted and, as with the first preferred embodiment, act to pinch the covering material within the cavities 128 to give the covering material an overall drum tight and taut appearance. As is also best shown in FIG. 7, the covering material 178 curves around the bulbous shaped ends of the framing members to give the covering material a more presentable appearance and to prevent ripping. It is also envisioned that lighting elements, such as fluorescent lighting rod fixtures 192, may be mounted within the construction assembly, such as to an inside surface of a sign box, so that sufficient illumination of the light through the covering fabric is accomplished to clearly highlight the display indicia on the bleed sign face.

Figure 13:
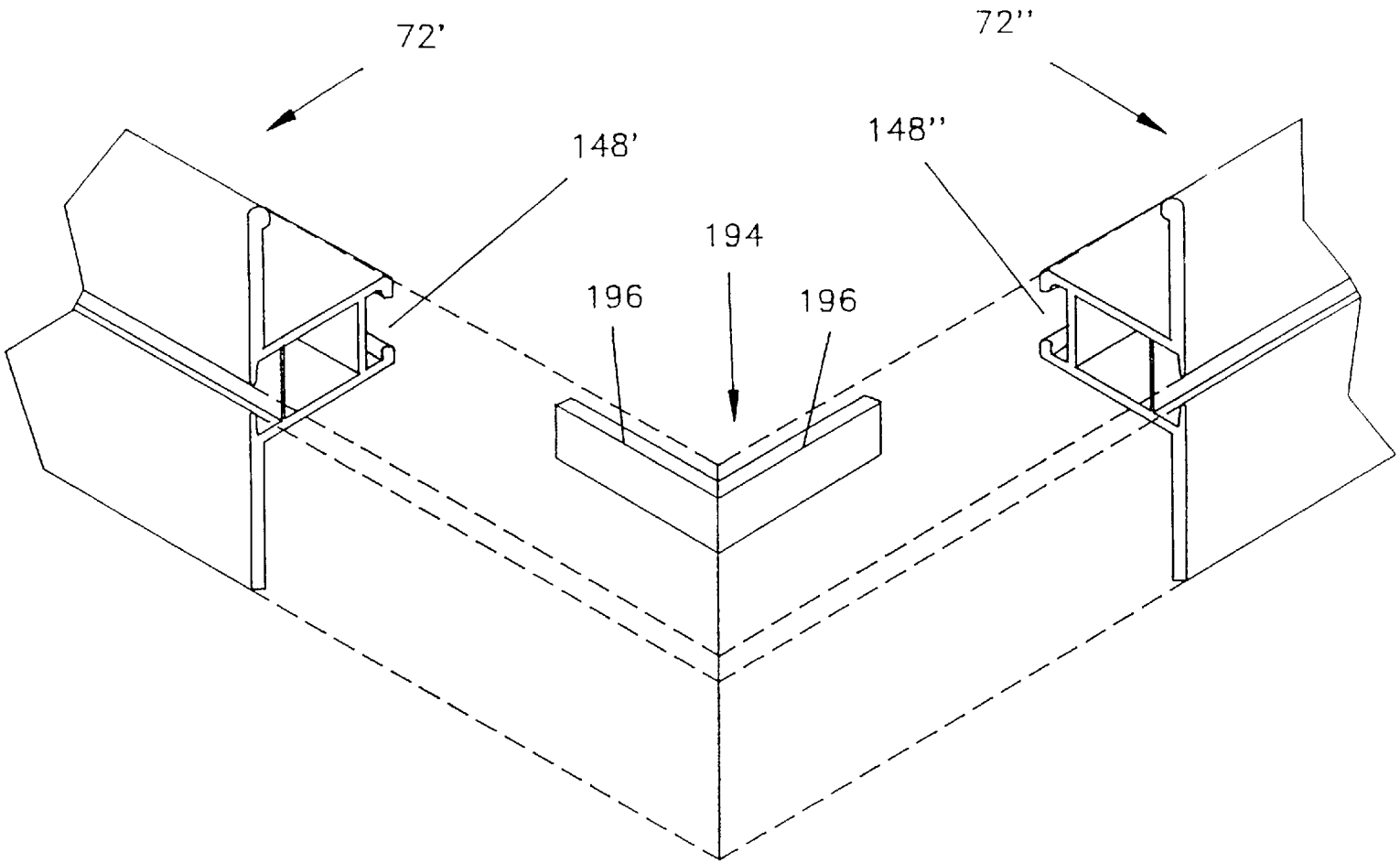
FIG. 13 is an exploded view of a pair of framing members which are connected together in an angular fashion for establishing an enclosed perimeter of the assembly according to a second preferred embodiment of the present invention.

Referring finally to FIGS. 7, 9 and 13 in combination, it is evident as to how a plurality of framing members are secured together in a polygonal and end to end fashion to create a three dimensional enclosure around the sign boxes 80 and 82, the pairs of back braces (illustrated by 150 and 152) and the plurality of angularly extending backset braces (shown again as 154, 156, 158 and 160) about which the bleed sign covering material 178 is secured. As with the first preferred embodiment, an internal corner support 194 is provided consisting of first and second angled legs 196 and 198 which are respectively secured in a tight friction fit manner within oppositely facing and longitudinally extending cavities 148' and 148" of a pair of angled framing members 72' and 72". The framing members 72' and 72" in FIG. 13 are illustrated with generally flattened ends, however it is understood that they are preferably angled through a miter cut so that they exhibit an end profile such as is substantially shown by frame member 72 in FIG. 9. The brace member 72 in FIG. 9 further illustrates the preferred arrangement of the corner support 194 within the cavity 148 relative to the positioning of the backset brace 154. The legs 196 and 198 of the corner support 194 may dimensioned to engage in a tight friction fit manner within the cavities 148 or, referring to FIG. 9, apertures 200 may be formed within a selected leg of the corner support for facilitating the insertion of additional fasteners (not shown) to secure the interconnecting frame members to the corner brace.

Figure 14:
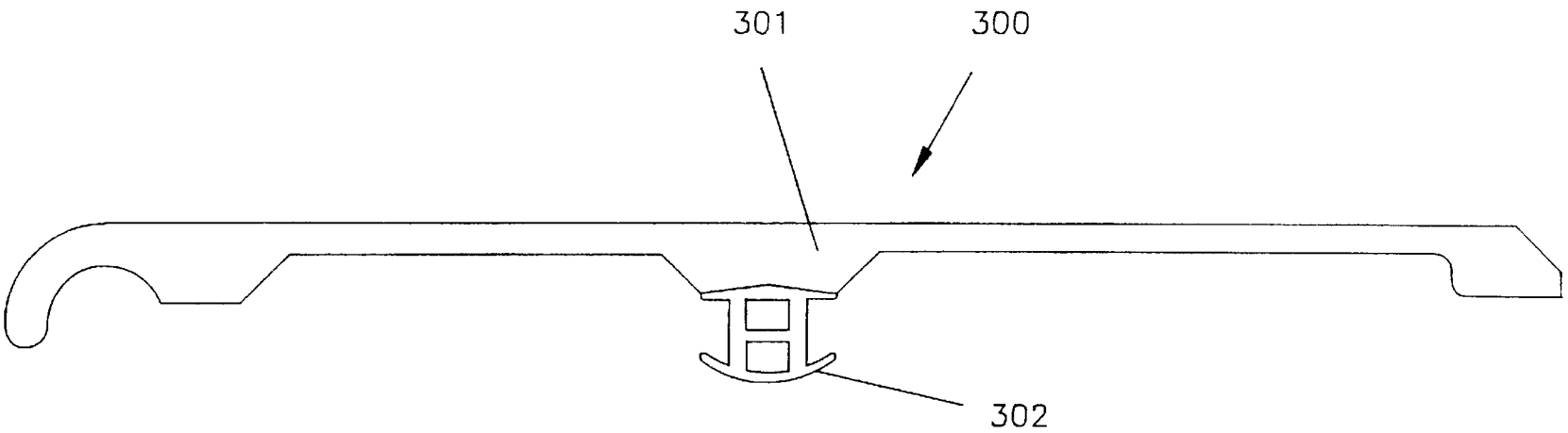
FIG. 14 is a cross sectional view of a vinyl insert together with an integral flange cover.
Figure 15:
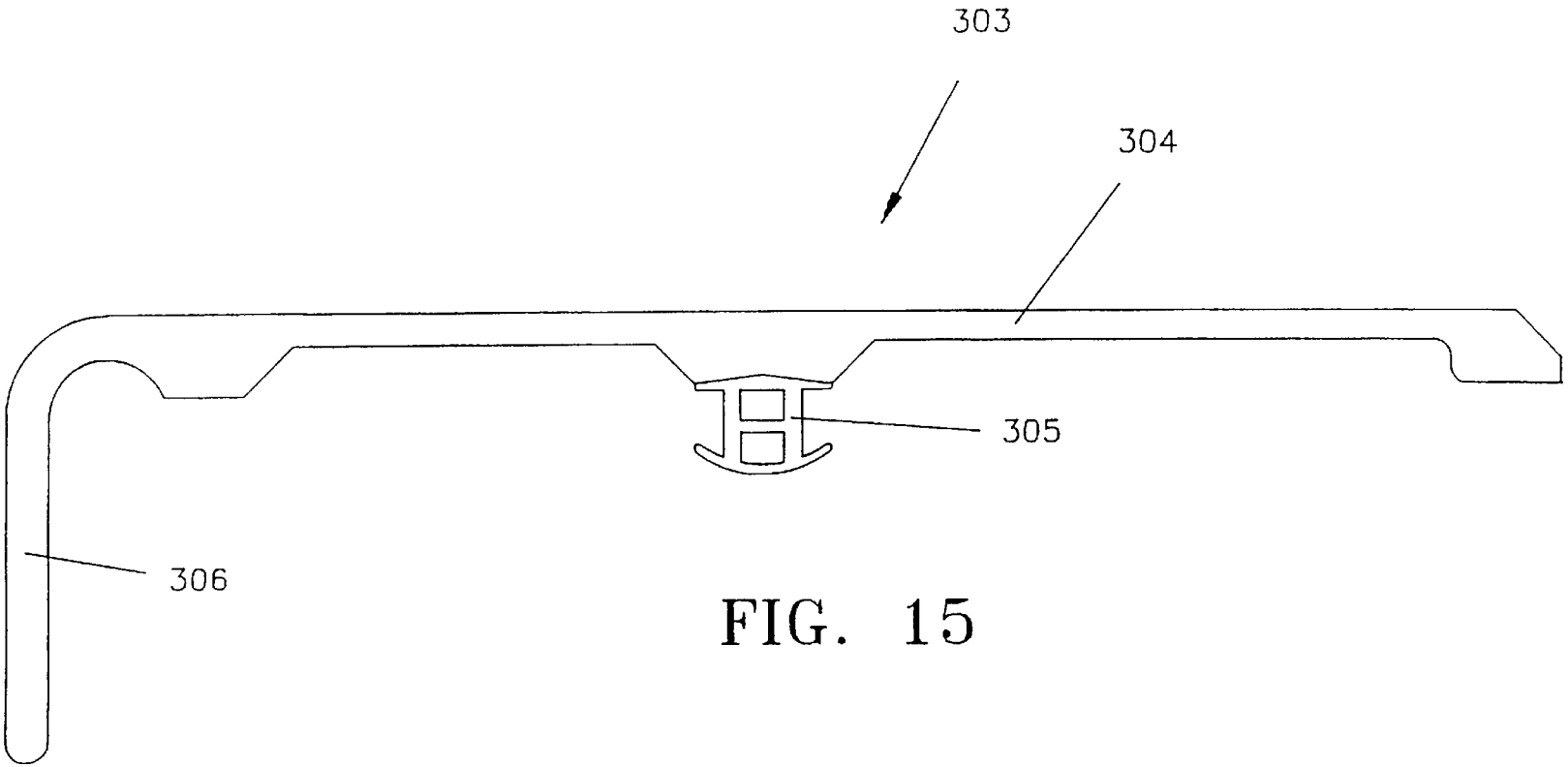
FIG. 15 is a cross sectional view of another embodiment of a vinyl insert together with an integral flange cover.
Figure 16:
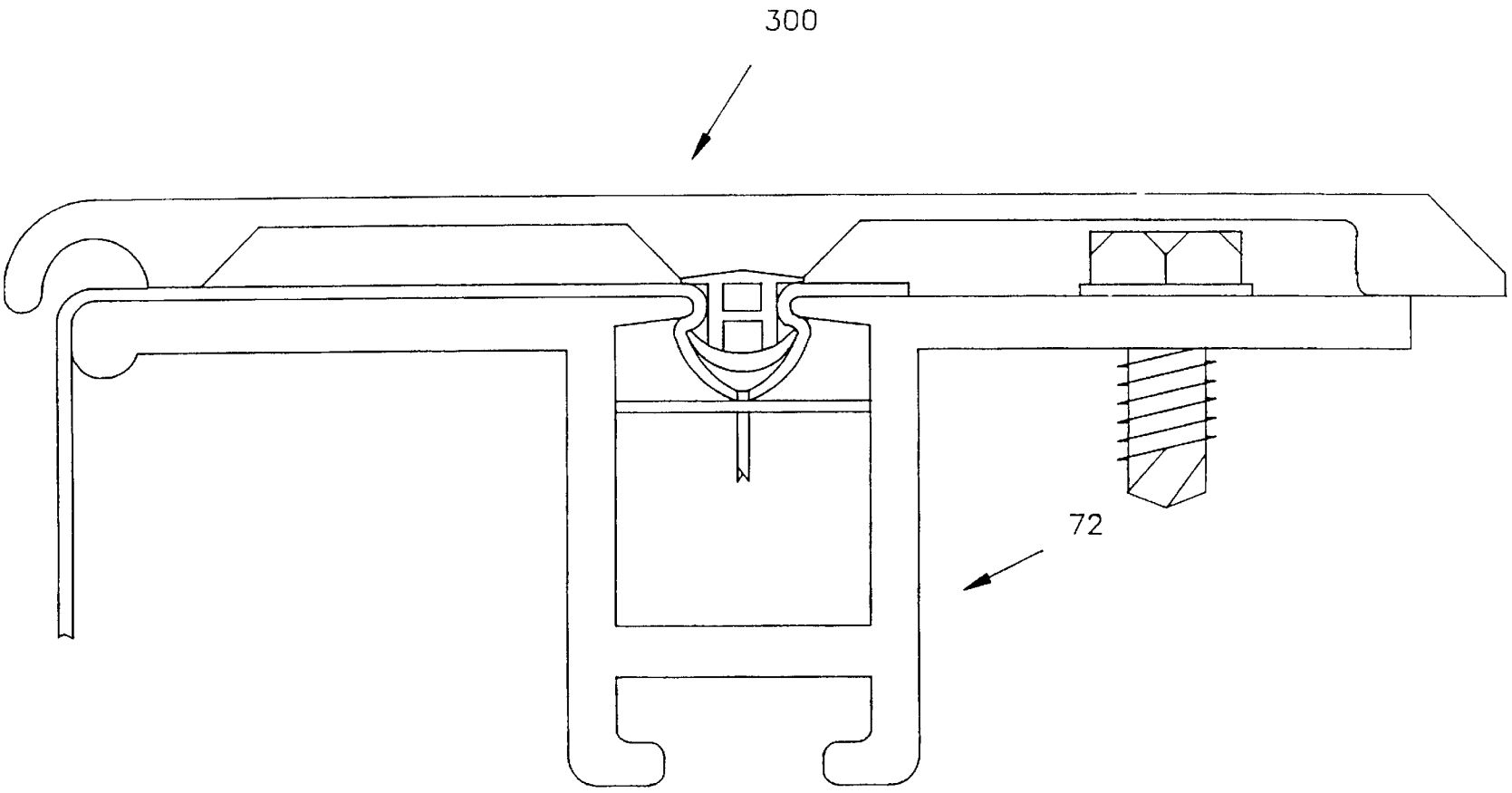
FIG. 16 is a cross sectional view of the vinyl insert illustrated in FIG. 14 shown installed over a framing member such as that illustrated in FIG. 8.

Referring to FIG. 14, a vinyl insert 300 is illustrated. It includes a covering portion 301 and an insert portion 302. The vinyl insert can be made such that its flexibility can be controlled. Specifically, the insert portion of the insert may be made of a more flexible material than the covering portion 301. FIG. 15 illustrates another embodiment of the vinyl insert 303 including a covering portion 304 and an insert portion 305. The insert of FIG. 15 is substantially similar to the insert of FIG. 14 except it includes an end portion 306 extending generally perpendicularly from the orientation of the covering portion 304. FIG. 16 illustrates the vinyl insert installed in the framing member of FIG. 8.

Figure 17:
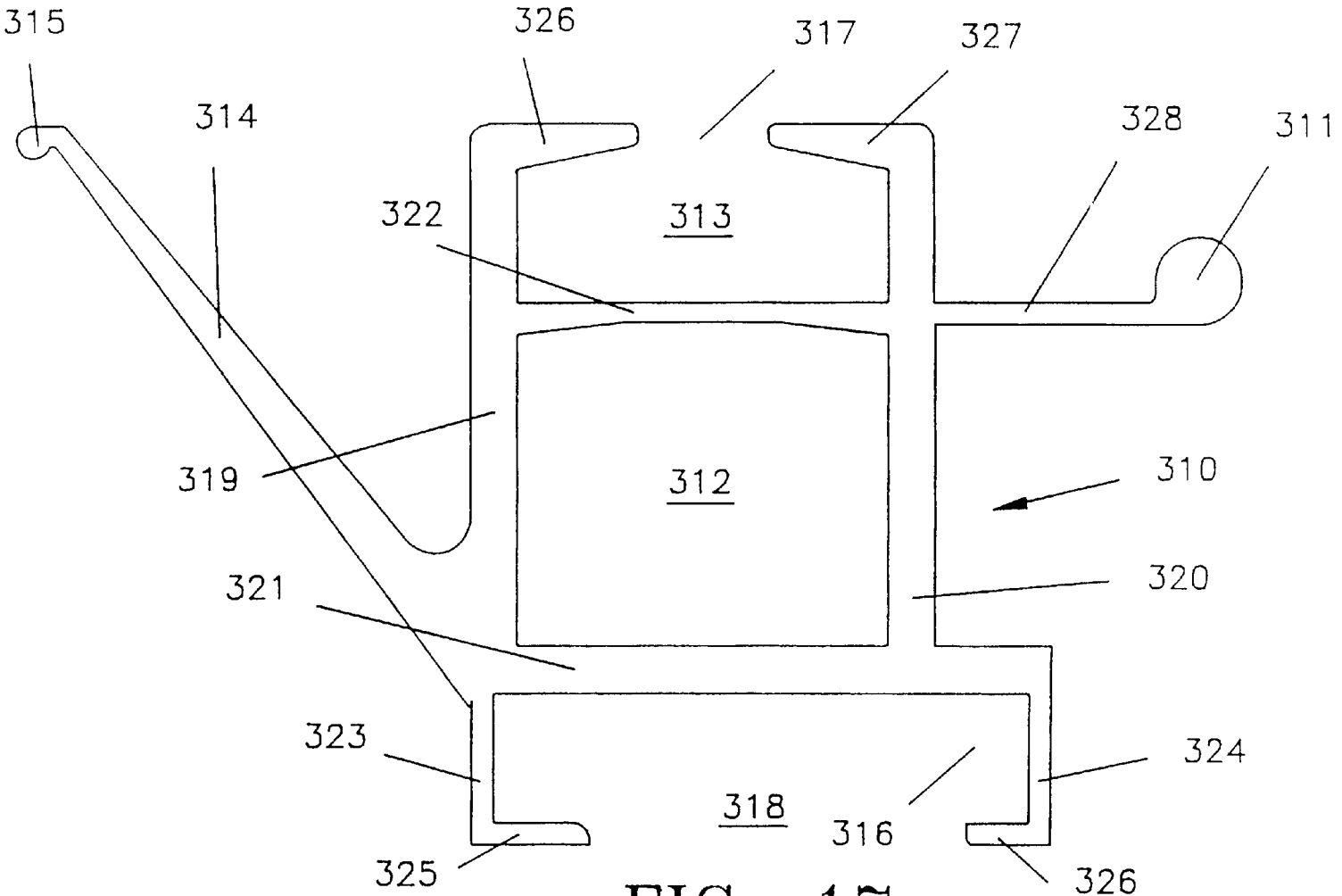
FIG. 17 is a cross sectional view of another embodiment of a framing member.

FIG. 17 is another embodiment of a framing member 310. Framing member 310 includes slots 317 and 318 at opposite ends thereof which interconnect to cavities 313 and 316 respectively. Interior cavity 312 is formed by walls 319, 320, 321, and 322. Cavity 316 is formed by walls 321, 323, and 324 as well as end portions 325 and 326. Similarly, cavity 313 is formed by walls, 319, 320, 322 and end portions 326 and 327. An angled member 314 extends from wall 319 and terminates in a first bulbous portion 315. Similarly, member 328 extends perpendicularly from wall 329 and terminates in a second bulbous portion 311. Framing member 310 is used in retrofit applications as well as in original applications.

The present invention therefore discloses a unique framing member used in a bleed sign construction assembly which permits the creation or retrofit of walls and pole signs. It is also envisioned that other polygonal shaped signs could be created according to the invention which exhibit any number of display face sides.

A further advantage of the use of the flexible and light permeable fabric is that it provides a more attractive and durable alternative to prior art polycarbonate panels which tend to blow out during high winds. The provision of staples and flexible vinyl inserts also permits a user to more quickly install a covering material displaying some form of advertising indicia to the construction assembly while still presenting a neat and drum tight appearance.

Having described my invention, additional embodiments will become apparent to those skilled in the art to which it pertains without deviating from the scope of the appended claims.

What is claimed is:

1. A framing member for use in a bleed sign, said framing member comprising:

a substantially elongate and unitary joinable member having a body which is defined in cross section by a selected width and height, wherein the joinable member comprises an insert accepting first slot; a second slot; a first cavity; a second cavity; and an enclosed interior cavity located between said first cavity and said second cavity; said first cavity includes said first slot and said second cavity includes said second slot; said interior cavity formed by first, second, third and fourth walls; a first end portion interconnecting with said first wall and a second end portion interconnecting with said second wall; said first cavity formed by said first wall, said third wall, said second wall and said first and second end portions; a third end portion interconnecting with said first wall and a fourth end portion interconnecting with said second wall; said second cavity formed by said first wall, said second wall, said fourth wall and said third and fourth end portions; a first extending member extending from said first wall; and a second extending member extending from said second wall for securing to a projecting mounting surface of a construction assembly to arrange said body at a spaced distance therefrom;

means for anchoring a covering material into said first cavity; and means for connecting the joinable member together in end to end fashion with an additional joinable member to form a closed perimeter across which the covering material is drawn.

2. The framing member according to claim 1, wherein said first extending member extends perpendicularly from said first wall and wherein said second first extending member extends perpendiculary from the second wall.

3. The framing member according to claim 1, wherein said anchoring means is a staple.

4. The framing member according to claim 3, further comprising a plurality of flexible inserts which are engaged within said first slot to tension the covering material against the framing member.

5. The framing member according to claim 1, wherein said framing member further comprises a mounting fastener for securing said second extending member to said projecting mounting surface.

6. The framing member according to claim 1 or 2, wherein the first extending member terminates in a bulbous member.

7. The framing member according to claim 1, wherein said framing member further comprises a mounting fastener for securing said second extending member to a lateral projecting end of a sign box.

8. The framing member according to claim 7, further comprising a backset brace assembly for securing said framing member to a vertically extending back brace.

9. The framing member according to claim 8, said backset brace assembly further comprising a centrally extending portion, a first angled and back brace engaging portion and a second angled and frame engaging portion.

10. The framing member according to claim 9, further comprising a mounting fastener for securing said first angled and back brace engaging portion to a planar face of the vertically extending back brace, said second angled and frame engaging portion inserting axially within a cross sectional end of said second cavity.

11. The framing member according to claim 1, wherein said means for connecting said joinable member comprises an internal corner support having a first angularly extending leg and a second angularly extending leg, said first leg for engaging within an axial end of a selected cavity of the joinable member and said second leg for engaging within an identical axial end of a selected cavity of the additional joinable member.

12. A combination framing member and bleed sign construction assembly, comprising:

said construction assembly including a mounting structure having a projecting mounting surface and at least one light fixture arrayed proximate to said projecting mounting surface which is encased within a light permeable covering material;

said framing member including a substantially elongate and unitay joinable member having a body which is defined in cross section by a selected width and height, wherein the joinable member comprises an insert accepting first slot; a second slot; a first cavity; a second cavity; and an enclosed interior cavity located between said first cavity and said second cavity; said first cavity includes said first slot and said second cavity includes said second slot; said interior cavity formed by first, second, third and fourth walls; a first end portion interconnecting with said first wall and a second end portion interconnecting with said second wall; said first cavity formed by said first wall, said third wall, said second wall and said first and second end portions; a third end portion interconnecting with said first wall and a fourth end portion interconnecting with said second wall; said second cavity formed by said first wall, said second wall, said fourth wall and said third and fourth end portions; a first extending member extending from said first wall; and a second extending member extending from said second wall for securing to said projecting mounting surface of said construction assembly to arrange said body at a spaced distance therefrom;

means for anchoring a covering material into said first cavity; and means for connecting the joinable member together in end to end fashion with an additional joinable member to form a closed perimeter across which the covering material is drawn.

13. The combination framing member and bleed sign construction assembly according to claim 12, wherein said first extending member extends perpendicularly from said first wall and wherein said second extending member extends perpendicularly from the second wall.

14. The combination framing member and bleed sign construction assembly according to claim 12, wherein said anchoring means is a staple.

15. The combination framing member and bleed sign construction assembly according to claim 13, further comprising a plurality of flexible inserts which are engaged within said first slot to tension said covering material against said construction assembly.

16. The combination framing member and bleed sign construction assembly according to claim 12 or 13, wherein the first extending member terminates in a bulbous member.

17. The combination framing member and bleed sign construction assembly according to claim 12, said mounting structure comprising a longitudinally extending upper sign frame and a longitudinally extending lower sign frame, each of said sign frames including first and second laterally projecting ends, and wherein said framing member includes said joinable member, and a second, third and fourth joinable members securing to selected ones of said laterally projecting ends.

18. The combination framing member and bleed sign construction assembly according to claim 17, further comprising a plurality of back braces for supporting said sign frames in a fixed and spaced apart manner, a plurality of first, second, third and fourth backset brace assemblies securing said joinable members to selected ones of said back braces.

19. The construction framing member and bleed sign construction assembly according to claim 18, each of said backset brace assemblies further comprising a centrally extending portion, a first angled and back brace engaging portion and a second angled and frame engaging portion.

20. The combination framing member and bleed sign construction assembly according to claim 19, further comprising a mounting fastener for securing said first angled engaging portion of each backset brace to a planar face of said back brace, said second angled engaging portion inserting axially within a cross sectional end of said second cavity of said associated joinable member.

21. The combination framing member and bleed sign construction assembly according to claim 12, wherein said means for connecting said joinable members comprises an internal corner support having a first angularly extending leg and a second angularly extending leg, said first leg for engaging within an axial end of a selected cavity of the joinable member and said second leg for engaging within an identical axial end of a selected cavity of the additional joinable member.

22. A framing member composing an insert accepting first slot; a second slot; a first cavity; a second cavity; and, an enclosed interior cavity located between said first cavity and said second cavity; wherein said first cavity includes said first slot and said second cavity includes said second slot; said interior cavity formed by first, second, third and fourth walls; a first end portion interconnecting with said first wall and a second end portion interconnecting with said second wall; said first cavity formed by said first wall, said third wall, said second wall and said first and second end portions; a third end portion interconnecting with said first wall and a fourth end portion interconnecting with said second wall; said second cavity formed by said first wall, said second wall, said fourth wall and third and fourth end portions; an angled member extending from said first wall; and, a perpendicularly extending member extending from said second wall.

23. The framing member according to claim 22, wherein the first extending member terminates in a bulbous portion.

24. The framing member according to claim 22 or 23 wherein the second extending member terminates in a bulbous portion.

25. A framing member for use in a bleed sign, said framing member comprising:

a substantially elongate and unitary joinable member having a body which is defined in cross section by a selected width and height, wherein the joinable member comprises an insert accepting first slot; a second slot; a first cavity; a second cavity; and, an enclosed interior cavity located between said first cavity and said second cavity; said first cavity includes said first slot and said second cavity includes said second slot; said interior cavity formed by first, second, third and fourth walls; a first end portion interconnecting with said first wall and a second end portion interconnecting with said second wall; said first cavity formed by said first wall, said third wall, said second wall and said first and second end portions; a third end portion interconnecting with said first wall and a fourth end portion interconnecting with said second wall; said second cavity formed by said first wall, said second wall, said fourth wall and said third and fourth end portions; an angled member extending from said first wall and terminating in a first bulbous portion; and, a perpendicularly extending member extending from said second wall and terminating in a second bulbous portion;

means for anchoring a covering material into said first slot; and means for connecting the joinable member together in end to end fashion with an additional joinable member to form a closed perimeter across which the covering material is drawn.

* * * * *